United States Patent [19]

English et al.

[11] Patent Number: 4,766,348

[45] Date of Patent: Aug. 23, 1988

[54] SINGLE-ENDED METAL HALOGEN LAMP AND FABRICATION PROCESS EMPLOYING IONIZATION POTENTIAL SELECTION OF ADDITIVE GASES

[75] Inventors: George J. English, Reading; Harold L. Rothwell, Jr., Rowley; Mark Beschle, Danvers, all of Mass.

[73] Assignee: GTE Products Corporation, Danvers, Mass.

[21] Appl. No.: 502,773

[22] Filed: Jun. 9, 1983

[51] Int. Cl.[4] ..... H01J 61/06; H01J 61/20; H01J 61/33; H01J 61/54

[52] U.S. Cl. ..... 313/631; 313/634; 313/641

[58] Field of Search ..... 313/631, 620, 621, 641, 313/634, 642

[56] References Cited

U.S. PATENT DOCUMENTS

| | | | |
|---|---|---|---|
| 3,259,777 | 7/1966 | Fridrich | 313/631 X |
| 3,876,895 | 4/1975 | Lake et al. | 313/620 X |
| 4,308,483 | 12/1981 | Keefe et al. | 313/620 |

*Primary Examiner*—Leo H. Boudreau
*Assistant Examiner*—K. Wieder
*Attorney, Agent, or Firm*—Thomas H. Buffton

[57] ABSTRACT

A single-ended metal halide discharge lamp includes an elliptical-shaped envelope having a pair of electrodes sealed therein and a fill gas which includes metal halogen selected in accordance with the ionization potentials thereof to provide "white" light with minimal color separation. In another aspect, the above-described lamp is fabricated by a process wherein an elliptical-shaped envelope is formed, a pair of electrodes sealed therein and a gas fill is selected including argon, mercury and additive halogen gases selected in accordance with the ionization potentials thereof to provide "white" light with minimal color separation.

1 Claim, 1 Drawing Sheet

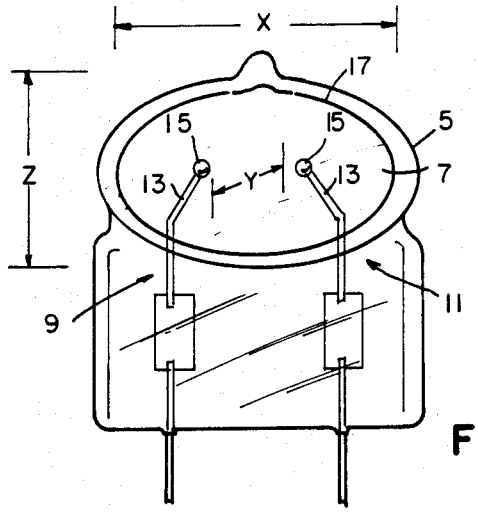
FIG. 1
| SPECIE | Ip (eV) |
|---|---|
| Hg | 10.4 |
| Zn | 9.4 |
| $T_l$ | 6.1 |
| $S_c$ | 6.6 |
| Li | 5.4 |
| Na | 5.1 |
| Dy | 6.8 |
FIG. 2
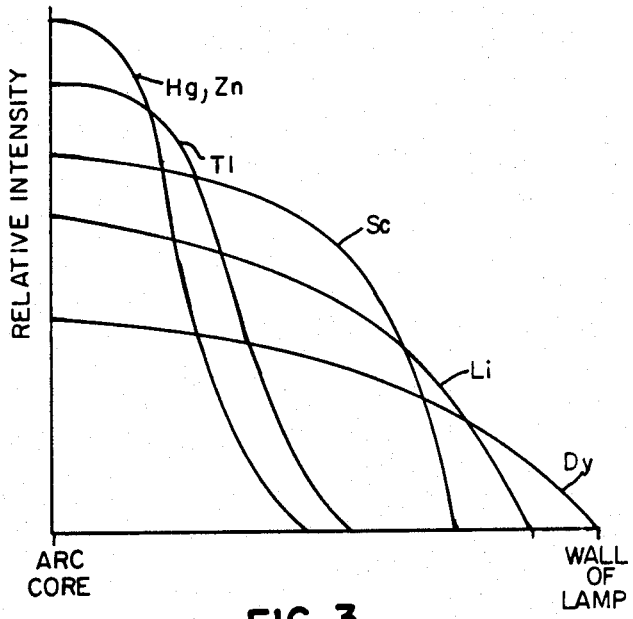
FIG. 3

SINGLE-ENDED METAL HALOGEN LAMP AND FABRICATION PROCESS EMPLOYING IONIZATION POTENTIAL SELECTION OF ADDITIVE GASES

CROSS REFERENCE TO OTHER APPLICATIONS

The following concurrently filed applications relate to single-ended metal halide discharge lamps and the fabrication thereof: Attorney's Docket Nos. 24,445; 24,823; and 83-1-058 and 83-1-085 bearing U.S. Ser. Nos. 502,775, now U.S. Pat. No. 4,528,478; 502,774, now abandoned; 502,772, now abandoned and 502,776, now U.S. Pat. No. 4,557,700.

TECHINICAL FIELD

This invention relates to single-ended metal halide discharge lamps and a process for fabricating such lamps and more paritcularly to single-ended metal halide lamps wherein additive gases are selected in accordance with ionization potentials directly related to relative intensity and inversely to spacial location of radiated energy.

BACKGROUND ART

Generally, it has been a common practice to employ tungsten lamps in apparatus requiring a relatively intense light source such as projectors, optical lens systems and similar apparatus. However, such apparatus is frequently configured in a manner which tends to develop undesired heat from such a light source and, in turn, requires expensive and cumbersome cooling devices in order to inhibit undesired overheating, distortion of the apparatus and catastrophic failure of the system.

Additionally, it is not uncommon to replace the light source each time the apparatus is used since the life expectancy of tungsten lamps used in projectors, for example, is relatively short, i.e., 10 to 20 hrs. of operational use. Obviously, such procedures are not only costly in equipment but also in replacement time as well. Thus, such apparatus and particularly the light source commonly used in such apparatus leaves much to be desired.

An improvement over the above-described tungsten lamp system is provided by a system utilizing a high intensity discharge lamp as a light source. For example, a common form of HID lamp is the high pressure metal halide discharge lamp as disclosed in U.S. Pat. No. 4,161,672. Therein is disclosed a double-ended arc tube configuration or an arc tube having electrodes sealed into diametrically opposite ends with an evacuated or gas-filled outer envelope. However, the manufacture of such double-ended structures is relatively expensive and the configuration is obviously not appropriate for use in projectors and similar optic-lens types of apparatus.

An even greater improvement in the provision of a light source for projectors and optic-lens apparatus is set forth in the single-ended metal halide discharge lamps as set forth in U.S. Pat. Nos. 4,302,699; 4,308,483; 4,320,322; 4,321,501 and 4,321,504. All of the above-mentioned patents disclose structure and/or fill variations which are suitable to particular applications. However, any one or all of the above-mentioned embodiments leave something to be desired insofar as arc stability and minimal color separation capabilities are concerned.

OBJECTS AND SUMMARY OF THE INVENTION

An object of the present invention is to provide an improved single-ended metal halide discharge lamp. Another object of the invention is to provide an enhanced light source having additive gases varying directly in relative intensity with the ionization potential thereof. Still another object of these inventions is to provide an improved process for fabricating single-ended metal halide discharge lamps. A further object of the invention is to provide a process for fabricating single-ended metal halide discharge lamps wherein additive gases are selected in accordance with ionization potentials inversely related to the spacial location of the radiation from a longitudinal axis intermediate a pair of spaced electrodes.

These and other objects, advantages, and capabilities are achieved in one aspect of the invention by a single-ended metal halide discharge lamp having a elliptical-shaped envelope of fused silica with a pair of electrodes sealed into one end thereof and a gas fill wherein additive gasses varying directly in relative intensity and inversely in spacial location from said electrodes in accordance with the ionization potentials thereof are disposed within the envelope.

In another aspect of the invention, a process for fabricating single-ended metal halide discharge lamps is provided wherein an elliptical-shaped envelope is formed, a pair of electrodes are sealed therein and a fill gas including additive gases selected in accordance with the ionization potential thereof are located within the envelope.

BRIEF DESCRIPTION OF THE DRAWINGS

FIG. 1 is a cross-sectional view of one embodiment of a single-ended metal halide discharge lamp of the invention;

FIG. 2 is a table listing metal additives in the order of increasing spacial extent and decreasing ionization potentials which are applicable to the discharge lamp of FIG. 1; and FIG. 3 is a chart illustrating both spectral intensity and special distribution from the center of a burning arc of various metal additives suitable to the discharge lamp of FIG. 1.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Referring to FIG. 1 of the drawings, FIG. 1 illustrates a low wattage metal halide lamp having a body portion 5 of a material such as fused silica. This fused silica body portion 5 is formed to provide an elliptical-shaped interior portion 7 having major and minor diametrical measurements, "X" and "Y" respectively, in a ratio of about 2:1. Moreover, the elliptical-shaped interior portion 7 of the body portion 5 preferably has a height "Z" substantially equal to the minor dimensional measurement "Y".

Sealed into one end of and passing through the body portion 5 is a pair of electrodes 9 and 11. Each of the electrodes 9 and 11 includes a metal rod 13 with a spherical ball 15 on the end thereof within the elliptical-shaped interior portion 7. Preferably, the electrodes 9 and 11 are positioned within the elliptical-shaped interior portion 7 in a manner such that the spherical balls 15 of the electrodes 9 and 11 are substantially equally spaced from minor axes. "X" and "Y", and also substantially at the midpoint of the height dimensions "Z". Moreover, the spherical balls 15 are spaced from one another along a longitudinal axis extending in the direction of the major axis "X".

Referring to the table of FIG. 2 and spectral intensity and spectral spacial distribution for additive gases of FIG. 3, it is to be noted that the ionization potential of the additive halogen metals varies directly with the spectral intensity of the particular additive. For example, mercury and zinc have the highest spectral intensity as well as the highest ionization potential. However, dysprosium appears to be an exception and is believed to be radiating predominantly as a molecule. Also, it is to be noted that the spacial distribution of the additive halogen metals varies inversely with the ionization potential. In other words, mercury and zinc radiate at a distance much closer to the axis between the electrodes than does lithium, for example, which radiates over a much larger volume.

As a specific but not to be construed as restrictive example, a preferred form of single-ended metal halide lamp structure was formed to have an elliptical configuration with a volume of about 0.15 $cm^3$ and an inner surface area of about 1.45 $cm^2$. A pair of electrodes of tungsten rod having a diameter of about 0.5 mm were sealed into the envelope and each had a spherical ball of about 1 mm on the end thereof. The lamp was operable from an AC source in the range of about 75 to 120 volts and a wattage of about 100 watts.

As to the fill gases of the above-described single-ended elliptical configuration, the following are typical but not limiting:

mercury—7.40 mg
lithium iodide—0.10 mg
zinc iodide—0.50 mg
scandium iodide—0.30 mg
thallium iodide—0.05 mg
dysprosium iodide—0.05 mg
argon—400.00 mm In accordance with the above-listed formulation, it was found that the dysprosium, used in small amounts, adds a yellow-orange to the light source while the lithium adds an orange-red color and peaks at the red transmission frequency of photographic colored film. Also, scandium provides blue, green and red light but additions are in limited quantities due to the sensitivity of the eye to the green radiation. Moreover, thallium provides increased lamp lumens by adding to the green light while zinc produces both blue and red radiation. Thus, it can be seen by proper selection of the additives, as determined by their ionization potential, a range of color radiation at a range of spacial distances from a core is obtainable. As a result, lamp radiation having a relatively "white" light with a minimum of color separation is provided.

Additionally, the above-described single-ended metal halide lamps are fabricated by a process wherein on elliptical-shaped fused silica envelope is formed, a pair of electrodes each having a spherical ball on the end thereof are passed through and sealed into the envelope and the envelope is filled with argon and mercury as well as additive metal halogen selected in accordance with the ionization potential thereof in order to provide radiated "white" light having a minimum of color separation.

While there have been shown and described what is at present considered the preferred embodiment of the invention, it will be obvious to those skilled in the art that various changes and modifications may be made therein without departing from the invention as defined by the appended claims.

What is claimed is:

1. A single-ended metal halide discharge lamp comprising:

an elliptical shaped envelope of fused silica having a volume of about 0.15 $cm^3$ and an inner surface area of about 1.45 $cm^2$;

a pair of electrodes sealed into and passing through said envelope with each of said pair of electrodes having a spherical ball on the end thereof within said envelope and said spherical balls spaced from one another along a longitudinal axis; and a gas fill within said envelope including 400 torr of argon, about 7.4 mg of mercury, and additive gases including 0.10 gm of lithium iodide, 0.50 mg of zinc iodide, 0.30 mg of scandium iodide, 0.05 mg of thallium iodide, and 0.05 mg of dysprosium iodide, said additive gases varying directly in relative intensity and inversely in spatial location from said longitudinal axis in accordance with the ionization potential thereof.

* * * * *